United States Patent [19]

Owen et al.

[11] 4,010,339

[45] Mar. 1, 1977

[54] SPRING CONTACT SWITCH

[75] Inventors: Allan B. Owen, Montoursville; Thomas M. Lynch, Williamsport, both of Pa.

[73] Assignee: GTE Sylvania Incorporated, Stamford, Conn.

[22] Filed: July 9, 1975

[21] Appl. No.: 594,327

[52] U.S. Cl. ..... 200/292; 200/283

[51] Int. Cl.[2] ..... H01H 3/12

[58] Field of Search ..... 200/292, 282, 283, 284, 200/275

[56] References Cited

UNITED STATES PATENTS

| | | | |
|---|---|---|---|
| 3,337,707 | 8/1967 | Juptner et al. | 200/283 |
| 3,749,872 | 4/1971 | Foster | 200/292 |

*Primary Examiner*—Herman J. Hohauser
*Attorney, Agent, or Firm*—Norman J. O'Malley; Thomas H. Buffton; Robert T. Orner

[57] ABSTRACT

A spring contact switch for a printed circuit board includes a flexible spring contact member affixed to a circuit board at one end and operatively available at an opposite end and an electrical component affixed to the circuit board with a lead member forward for contact by said flexible spring contact member.

1 Claim, 3 Drawing Figures

SPRING CONTACT SWITCH

BACKGROUND OF THE INVENTION

In many forms of electrical apparatus utilizing printed circuit boards and specifically in ground fault circuit interrupter GFCI assemblies, a momentary contact electrical switch is required. For example, a GFCI test switch is used to test the apparatus to insure proper operation and the switch must function reliably for more than 3000 operations. Moreover, the competitive nature of such apparatus requires a minimum cost in both labor and materials but maximum reliability and repeatability.

One known form of switching member employed in a GFCI assembly utilizes a plastic pushbutton, spring, two stationary contacts, and a moveable contact. Obviously, such complex switching circuitry is expensive of labor and materials and complex enough to present reliability problems.

In another known form, the switching member employed in a GFCI assembly included a moveable switch contact having several parts soldered to one another and a special base wire mounted on a circuit board and positioned for contact by the moveable switch contact member. Again, the complexity of the apparatus tends to indicate undesirable labor and material cost as well as questionable reliability.

OBJECTS AND SUMMARY OF THE INVENTION

An object of the present invention is to provide an enhanced spring contact switch member. Another object of the invention is to provide an improved spring contact switch member having a low labor and material cost and high reliability and repeatability. Still another object of the invention is to provide an enhanced momentary contact type spring contact switch especially suitable for use in a GFCI assembly.

These and other objects, advantages and capabilities are achieved in one aspect of the invention by a self-supporting single piece spring contact switch for a printed circuit board having a flexible spring contact member with one end affixed to the printed circuit board and the opposite end available for operation and an electrical contact affixed to the printed circuit board with a lead member formed for contact by said flexible spring contact member.

PREFERRED EMBODIMENT OF THE INVENTION

For a better understanding of the present invention, together with other and further objects, advantages and capabilities thereof, reference is made to the following disclosure and appended claims in connection with the accompanying drawings.

Figure 1:
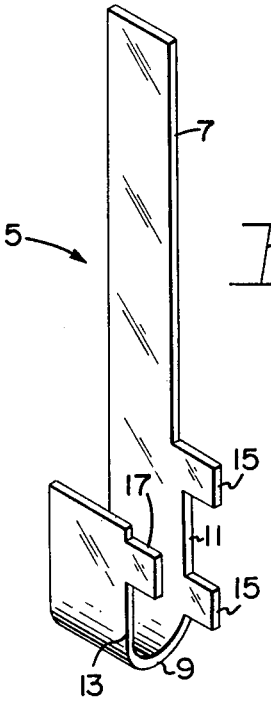
FIG. 1 is a perspective view of a flexible spring contact member suitable for use in a spring contact switch.

Referring to the drawings, FIG. 1 illustrates a flexible spring contact member 5 which is substantially "J"-shaped. The spring contact member 5 includes a substantially flat portion 7 extending from a substantially "U"-shaped portion 9. The U-shaped portion 9 of the contact member has a pair of leg members 11 and 13 with the leg member 11 affixed to the flat portion 7 and a pair of mounting members 15 extending outwardly from the leg member 11. Another mounting member 17 extends outwardly from the other leg member 13 of the pair of leg members 11 and 13.

Figure 2:
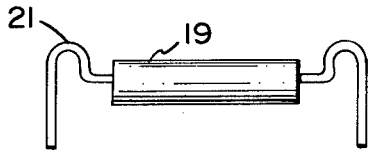
FIG. 2 is an illustration of an electrical component member having a lead member formed for contact by the flexible spring contact member.

FIG. 2 illustrates an electrical component 19, which may be in the form of a resistor for example, having a lead member 21 formed for contact with the flexible spring contact member 5 of FIG. 1. Obviously, components other than resistors are equally applicable for providing formed lead members to serve as contacts.

Figure 3:
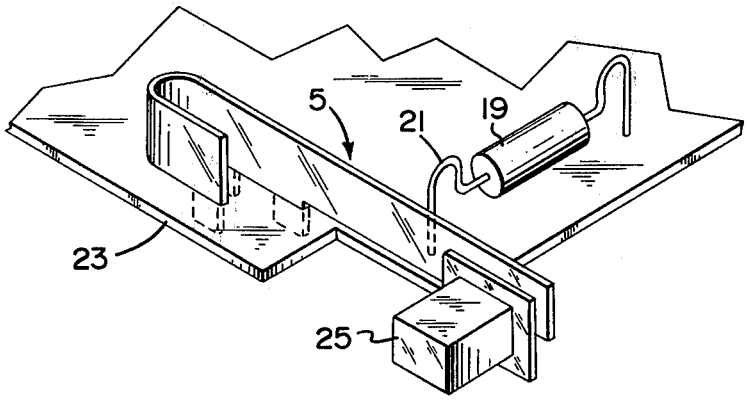
FIG. 3 is a preferred embodiment of a spring contact switch utilizing the apparatus of FIGS. 1 and 2.

FIG. 3 illustrates the embodiments of FIGS. 1 and 2 assembled in a manner to provide a spring contact switch. A printed circuit board 23 has the flexible spring contact member 5 mounted thereon with the mounting members 15 and 17 passing therethrough. Moreover, the mounting members 15 and 17 are normally affixed upon passage of the circuit board 23 over a wave soldering machine for example.

Similarly, the electrical component 19 is affixed to the circuit board 23 in a normal manner such as by soldering the formed lead members 21. Also, one of the formed lead members 21 is closely adjacent to but spaced from the flat portion 7 of the flexible spring contact member 5. Moreover, a pushbutton 25 operates the switch at the flat portion 7 of the flexible spring contact member 5 for operator convenience.

As to operation, an operator merely depresses the pushbutton 25 to provide momentary contact of the flat portion 7 of the flexible spring member 5 and the formed lead member 21 of the electrical component 19. Thereupon, the desired contact of the flexible spring contact member and formed lead member of the electrical component is effected. The spring contact member 5 returns to normal position after pressure to pushbutton 25 is released.

Thus, there has been provided a unique flexible spring contact switch developed from a single unit of material. The switch is inexpensive of materials and assembly labor while providing a much desired reliability of action.

Further, the positional location of the mounting members 15 and 17 as well as the "J"-shaped configuration of the flexible spring contact member 5 has been found advantageous. For example, the three-point suspension provided by the mounting members 15 and 17 not only serve to maintain the flexible spring contact member 5 in a desired upright position after assembly and prior to attachment by soldering but also serve to inhibit undesired flexure and fatigue of the contact member 5 which was experienced when only the mounting members 15 were provided.

Additionally, the above-described spring contact switch is especially suitable to ground fault circuit interrupter (GFCI) apparatus wherein a momentary switch apparatus is utilized for testing the circuit breaker action. Thus, an operator merely depresses the pushbutton to effect the test and without further manipulation the apparatus is in condition to repeat the test.

While there has been shown and described what is at present considered a preferred embodiment of the invention, it will be obvious to those skilled in the art that various changes and modifications may be made therein without departing from the invention as defined by the appended claims.

What is claimed is:

1. A spring contact switch for direct printed circuit board mounting comprising:

a flexible spring contact member affixed to a printed circuit board at one end and operatively available at the other end, said flexible spring contact member being substantially J-shaped with a U-shaped portion having two leg members with one of the leg members attached to an extended flat portion and having two mounting members extending outwardly therefrom and the other leg member having a third mounting member extending outwardly therefrom; and electrical component means affixed to said circuit board and having a lead member formed for contact by said flexible spring contact member.

* * * * *